US012391506B2

(12) United States Patent
Watanabe et al.

(10) Patent No.: US 12,391,506 B2
(45) Date of Patent: Aug. 19, 2025

(54) READING APPARATUS, CONVEYING OPERATION CONTROL METHOD AND STORAGE MEDIUM

(71) Applicant: Konica Minolta, Inc., Tokyo (JP)

(72) Inventors: Masayuki Watanabe, Fuchu (JP); Hidenori Mine, Tachikawa (JP); Harumitsu Fujimori, Toyokawa (JP); Takanobu Shiki, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 472 days.

(21) Appl. No.: 17/829,639

(22) Filed: Jun. 1, 2022

(65) Prior Publication Data

US 2022/0380164 A1 Dec. 1, 2022

(30) Foreign Application Priority Data

Jun. 1, 2021 (JP) ..... 2021-092460

(51) Int. Cl.
*B65H 29/12* (2006.01)
*B65H 43/08* (2006.01)

(52) U.S. Cl.
CPC ..... *B65H 29/125* (2013.01); *B65H 43/08* (2013.01); *B65H 2301/544* (2013.01); *B65H 2404/16* (2013.01); *B65H 2513/11* (2013.01); *B65H 2515/32* (2013.01); *B65H 2801/27* (2013.01); *B65H 2801/39* (2013.01)

(58) Field of Classification Search
CPC ..... B65H 29/125; B65H 2513/11; B65H 2515/32; B65H 2301/544
See application file for complete search history.

(56) References Cited

U.S. PATENT DOCUMENTS

| | | | | |
|---|---|---|---|---|
| 9,278,824 | B2 * | 3/2016 | Hamano | B65H 18/26 |
| 9,770,925 | B2 * | 9/2017 | Hamano | B65H 23/198 |
| 10,710,829 | B2 * | 7/2020 | Yamaguchi | G03G 15/6529 |
| 11,838,469 | B2 * | 12/2023 | Mine | H04N 1/00588 |
| 2018/0265314 | A1 * | 9/2018 | Seki | G03G 15/1615 |

FOREIGN PATENT DOCUMENTS

| | | | | |
|---|---|---|---|---|
| JP | 2003291433 | A * | 10/2003 | B65H 3/0669 |
| JP | 2014-186354 | A | 10/2014 | |
| JP | 2016-103719 | A | 6/2016 | |
| JP | 2017-072632 | | 4/2017 | |
| JP | 2020-154094 | A | 9/2020 | |

OTHER PUBLICATIONS

Japan Patent Application No. 2021-092460; Notice of Reasons for Refusal; dated Mar. 4, 2025; 16 pages.

* cited by examiner

*Primary Examiner* — Patrick Cicchino
(74) *Attorney, Agent, or Firm* — BakerHostetler

(57) ABSTRACT

A reading apparatus includes a reader, a conveyor, motors and a hardware processor. The reader reads a surface of a recording medium with an image formed. The conveyor includes rollers disposed along a conveyance path that passes through a reading area of the reader, and conveys the recording medium being laid across the rollers. The motors rotate the rollers. The hardware processor controls operations of the motors such that the rollers located farther downstream in a conveyance direction of the recording medium rotate faster. As to at least one motor of the motors, the hardware processor switches between and performs a first control to adjust a rotational speed and a second control to adjust a torque, depending on an operating state of the motor.

12 Claims, 8 Drawing Sheets

READING APPARATUS, CONVEYING OPERATION CONTROL METHOD AND STORAGE MEDIUM

CROSS-REFERENCE TO RELATED APPLICATIONS

This application claims priority to Japanese Patent Application No. 2021-092460 filed on Jun. 1, 2021, the entirety of which is incorporated herein by reference.

BACKGROUND

Technological Field

The present disclosure relates to a reading apparatus, a conveying operation control method and a storage medium.

Description of the Related Art

There are image reading apparatuses that capture and thereby read images on recording media. There is disclosed, for example, in JP 2017-72632 A, an image reading apparatus that images the surface of a recording medium at intervals with a fixed line sensor(s) or the like while conveying the recording medium. As a method for conveying recording media, there is known a method of rotating roller pairs with motors while holding a recording medium with the roller pairs, thereby moving the recording medium as the roller pairs rotate while passing the recording medium from one roller pair to another. As the motors, stepping motors that easily achieve accurate rotation amounts are widely used.

SUMMARY

However, force (torque) necessary for motors to rotate roller pairs when a reading apparatus conveys a recording medium varies depending on the conveying speed, material, surface properties, size and so forth of the recording medium. In order for stepping motors to accurately convey a recording medium, the stepping motors are each driven to produce the expected maximum torque to prevent themselves from losing steps, which, in many cases, results in the stepping motors consuming large power by being driven by excessive force.

To deal with the above problem, it is conceivable to use motors different from stepping motors, for example, brushless motors. However, it has been found that replacement of stepping motors with other motors causes the following problems.

In a system including a reader that reads images on image-formed recording media, it is necessary to keep a certain distance between the sensor of the reader and each recording medium in order to ensure reading accuracy. For that, it is necessary to control and drive motors to produce a difference in speed between an upstream roller and a downstream roller, and convey a recording medium by pulling it downstream. When the bottom edge of a recording medium exits the upstream roller while the recording medium is being conveyed by the downstream roller carrying (taking) a large load of the upstream roller too, an abrupt change occurs in the load of the downstream roller, and a large change occurs in the speed of the downstream roller accordingly. This greatly changes (fluctuates) the conveying speed of the recording medium, thereby vibrating or bending the recording medium in the reading area, and making it impossible to keep a certain distance between the sensor of the reader and the recording medium and greatly reducing reading accuracy accordingly.

Objects of the present disclosure include providing a reading apparatus, a conveying operation control method and a storage medium storing a program each of which can convey recording media more efficiently while curbing decrease in reading accuracy.

In order to achieve at least one of the aforementioned objects, according to a first aspect of the present disclosure, there is provided a reading apparatus including:

- a reader that reads a surface of a recording medium with an image formed;
- a conveyor that includes rollers disposed along a conveyance path that passes through a reading area of the reader, and conveys the recording medium being laid across the rollers;
- motors that rotate the rollers; and
- a hardware processor that
  - controls operations of the motors such that the rollers located farther downstream in a conveyance direction of the recording medium rotate faster, and
  - as to at least one motor of the motors, switches between and performs a first control to adjust a rotational speed and a second control to adjust a torque, depending on an operating state of the motor.

In order to achieve at least one of the aforementioned objects, according to a second aspect of the present disclosure, there is provided a conveying operation control method for a reading apparatus including: a reader that reads a surface of a recording medium with an image formed; a conveyor that includes rollers disposed along a conveyance path that passes through a reading area of the reader, and conveys the recording medium being laid across the rollers; and motors that rotate the rollers, including:

- as to at least one motor of the motors, switching between and performing a first control to adjust a rotational speed and a second control to adjust a torque, depending on an operating state of the motor,
- wherein set speeds of the motors are determined such that the rollers located farther downstream in a conveyance direction of the recording medium rotate faster.

In order to achieve at least one of the aforementioned objects, according to a third aspect of the present disclosure, there is provided a non-transitory computer-readable storage medium storing a program that causes a computer of a reading apparatus including: a reader that reads a surface of a recording medium with an image formed; a conveyor that includes rollers disposed along a conveyance path that passes through a reading area of the reader, and conveys the recording medium being laid across the rollers; and motors that rotate the rollers, wherein set speeds of the motors are determined such that the rollers located farther downstream in a conveyance direction of the recording medium rotate faster, to:

- as to at least one motor of the motors, switch between and perform a first control to adjust a rotational speed and a second control to adjust a torque, depending on an operating state of the motor.

BRIEF DESCRIPTION OF THE DRAWINGS

The advantages and features provided by one or more embodiments of the present disclosure will become more fully understood from the detailed description given hereinbelow and the appended drawings that are given by way of illustration only, and thus are not intended as a definition of the limits of the present disclosure, wherein.

DETAILED DESCRIPTION OF THE EMBODIMENTS

Hereinafter, one or more embodiments of the present disclosure will be described with reference to the drawings.

Figure 1:
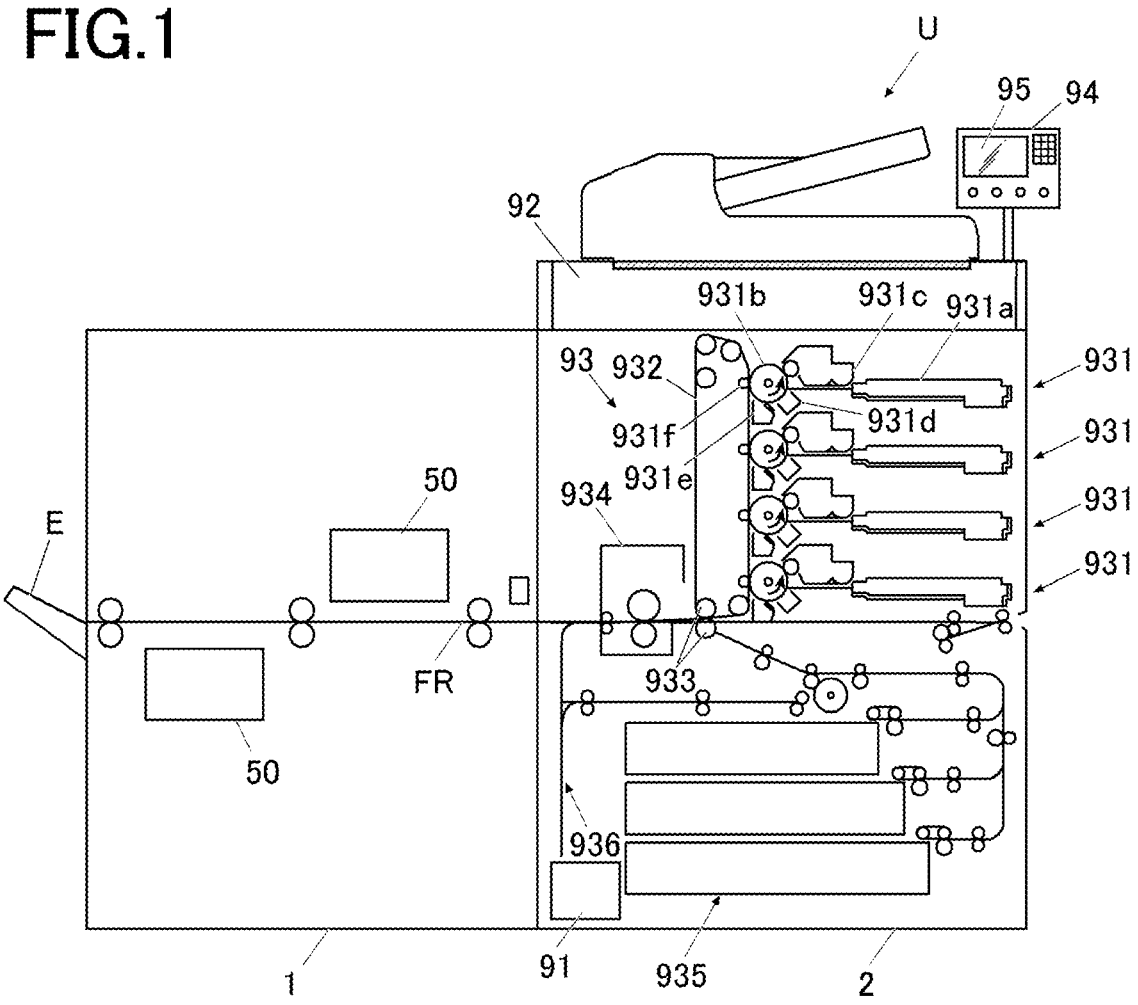
FIG. 1 schematically shows overall configuration of an image forming system.

FIG. 1 shows overall configuration of an image forming system U of an embodiment(s).

The image forming system U includes an image forming apparatus 2 and a reading apparatus 1.

The image forming apparatus 2 is, for example, a multifunction peripheral that forms and outputs images on recording media on the basis of image data read from documents, and also, for example, electrophotographically forms and outputs images on recording media on the basis of image data received from external apparatuses (not shown), such as PCs, via a LAN (Local Area Network) or the like.

The image forming apparatus 2 includes a controller 91, a document reader 92, an image former 93, an operation receiver 94 and a display 95.

The controller 91 includes a CPU (Central Processing Unit) and a RAM (Random Access Memory), and controls overall operation of the image forming apparatus 2. The CPU performs various types of settings and operation related to image forming in accordance with operation signals input through the operation receiver 94 or instruction signals received through a not-shown communication unit.

The document reader 92 performs scanning and exposure on images of documents placed on a platen or an auto document feeder with an optical system of a scanning-exposure device and reads the reflected light with a line image sensor, thereby obtaining image signals. The document reader 92 performs A/D conversion, shading correction, compression and/or another process on the image signals, thereby generating image data The image former 93 forms, on recording media, color images each composed of, for example, four colors, C (cyan), M (magenta), Y (yellow) and K (black), in accordance with pixel values of the four colors of respective pixels of original image data, based on which images are formed, and ejects the recording media to the reading apparatus 1. The image former 93 includes four writers 931, an intermediate transfer belt 932, secondary transfer rollers 933 and a fixing unit 934.

The four writers 931 are arranged in series (tandem) along the belt surface of the intermediate transfer belt 932, and form images of C, M, Y and K colors, respectively. The writers 931 may be the same in configuration, and each include an optical scanner 931*a*, a photoreceptor (image holder) 931*b*, a developing device 931*c*, a charger 931*d*, a cleaner 931*e* and a primary transfer roller 931*f*.

In each writer 931, the photoreceptor 931*b* is uniformly charged by the charger 931*d*, and then scanned and exposed with light beams emitted by the optical scanner 931*a* on the basis of original image data, so that an electrostatic latent image is formed thereon. This electrostatic latent image is developed by the developing device 931*c* supplying a color material, such as toner, thereto, so that an image is formed on the photoreceptor 931*b*.

The images formed on the photoreceptors 931*b* of the four writers 931 are transferred to the intermediate transfer belt 932 by their primary transfer rollers 931*f* so as to be on top of one another on the intermediate transfer belt 932 (primary transfer), so that an image composed of the four colors is formed on the intermediate transfer belt 932. The intermediate transfer belt 932 is wound around rollers to circularly move. After the primary transfer, the color materials remaining on the photoreceptors 931*b* are removed by the cleaners 931*e*.

In the image former 93, a recording medium is send out from a feeding tray 935 to the secondary transfer rollers 933 to be in sync with a timing at which the image on the circularly moving intermediate transfer belt 932 reaches the secondary transfer rollers 933. The secondary transfer rollers 933 are a pair of rollers. One of the rollers contacts the intermediate transfer belt 932 by pressure, and the other of the rollers is one of the rollers around which the intermediate transfer belt 932 is wound. The image on the intermediate transfer belt 932 is transferred to the recording medium by the secondary transfer roller(s) 933 contacting the intermediate transfer belt 932 by pressure (secondary transfer).

The recording medium is then conveyed to the fixing unit 934 at which a fixing process is performed on the recording medium. The fixing unit 934 includes a pair of fixing rollers that contact one another by pressure and at least one of which can perform heating. In the fixing process, the fixing rollers heat and pressurize the recording medium to fix the image thereon to the recording medium.

In the case of double-sided image forming, in which images are formed on both sides of a recording medium, a recording medium with an image formed on and fixed to one side is sent to a reversing path 936 to be reversed from the front side to the back side, and then sent back to an upstream position of the secondary transfer rollers 933. After an image is formed on one side of a recording medium in single-sided image forming, or images are formed on both sides of a recording medium in double-sided image forming, the recording medium is ejected to the reading apparatus 1.

The operation receiver 94 includes a touchscreen disposed on the screen of the display 95 and various hard keys arranged around the screen of the display 95, and receives input operations from the outside, for example, from a user. The contents of the received operations are converted into operation signals corresponding to the contents, and output to the controller 91. The touchscreen may be pressure-sensitive, electrostatic or optical, for example.

The display 95 has, for example, a color liquid crystal display, and displays various types of information under the control of the controller 91.

The reading apparatus 1 is located downstream of the image forming apparatus 2 in a conveyance direction of recording media. The reading apparatus 1 includes imagers 50. The reading apparatus 1 optically reads, with the imagers 50, both sides of each image-formed recording medium M output from the image forming apparatus 2 while conveying the recording medium M along a conveyance path FR. The read data may be used for adjusting color characteristics and image quality in the image forming apparatus 2 and/or detecting image abnormality. After being read, the recording medium M is ejected to a receiving tray E. Alternatively, a post-processing apparatus may be provided downstream of the reading apparatus 1 along the conveyance path FR. The post-processing apparatus may perform, for example, a cutting process.

Figure 2:
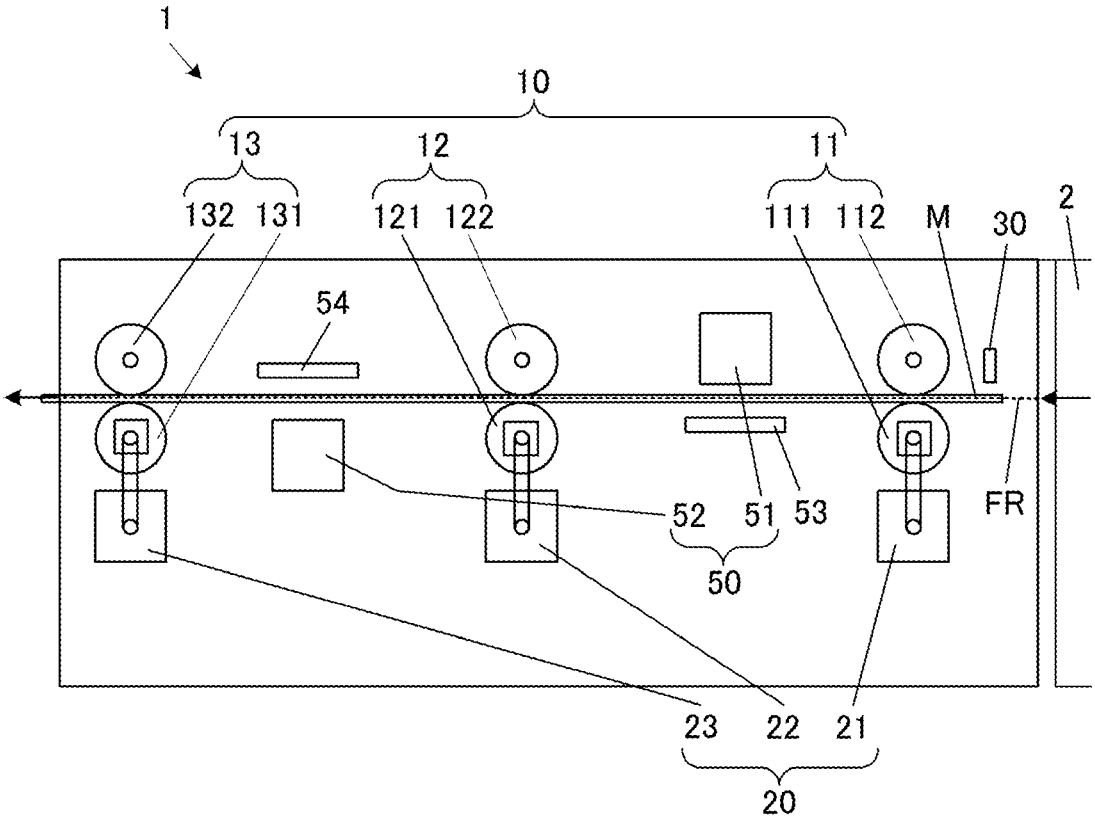
FIG. 2 shows configuration of a reading apparatus according to an embodiment(s)

FIG. 2 shows an enlarged view of the reading apparatus 1 of this embodiment to show configuration thereof.

The reading apparatus 1 includes a conveyor 10 that conveys recording media M supplied from the outside, brushless motors 20 that cause the conveyor 10 to move the recording media M at a set speed(s), a recording medium detector 30 that detects the supplied recording media M, and the aforementioned imagers 50 (reader(s)) that image and thereby read respective sides of the recording media M being conveyed.

The conveyor 10 includes three pairs of rollers (which hereinafter may be referred to as "roller pairs") 11, 12, 13 that are arranged in this order from upstream to downstream in the conveyance direction of recording media M. The brushless motors 20 are a first motor 21, a second motor 22 and a third motor 23 respectively for the roller pair 11, the roller pair 12 and the roller pair 13. The distance between the roller pairs 11, 12 and the distance between the roller pairs 12, 13 are each shorter than the length of a standard recording medium M in the conveyance direction. In this embodiment, the distance between the roller pairs 11, 13, which are arranged at the respective ends, is also shorter than the length of a standard recording medium M in the conveyance direction. Hence, each recording medium M is delivered and conveyed by being sandwiched between the rollers of respective roller pairs adjacent to one another and held thereby, simultaneously at some points. The recording media M are, for example, various types of sheets of printing paper, but not limited thereto.

The roller pair 11 includes a drive roller 111 driven by the first motor 21 and a driven roller 112 paired with the drive roller 111. When a recording medium M is inserted between the drive roller 111 and the driven roller 112, the drive roller 111 and the driven roller 112 both contact the recording medium M and hold it in between. The recording medium M moves at a speed corresponding to the rotational speed of the drive roller 111, and the driven roller 112 rotates at a speed corresponding to the moving speed of the recording medium M (i.e., as the drive roller 111 rotates). The driven roller 112 may contact the drive roller 111 and rotate as the drive roller 111 rotates even when no recording medium M is present between the drive roller 111 and the driven roller 112.

The roller pair 12 includes a drive roller 121 and a driven roller 122. The drive roller 121 is driven by the second motor 22. The roller pair 13 includes a drive roller 131 and a driven roller 132. The drive roller 131 is driven by the third motor 23. The positional relationship between the drive roller 121 and the driven roller 122 and the positional relationship between the drive roller 131 and the driven roller 132 are each the same as that between the drive roller 111 and the driven roller 112, and hence their descriptions will be omitted.

Figure 3:
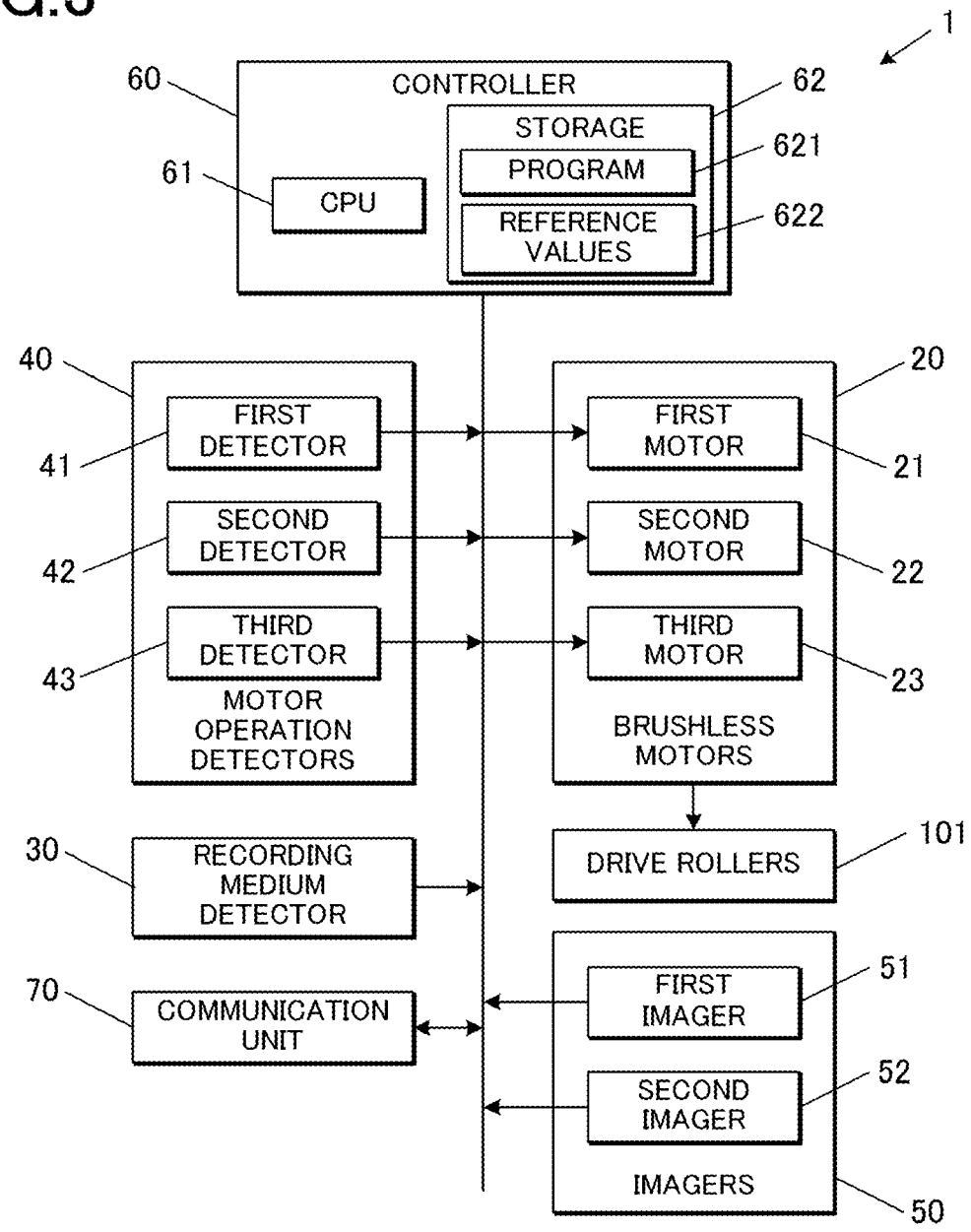
FIG. 3 is a block diagram showing a functional configuration of the reading apparatus according to the embodiment.

The drive rollers 111, 121, 131 may be referred to as drive rollers 101 (rollers) (shown in FIG. 3). The driven rollers 112, 122, 132 may be referred to as driven rollers 102 (pressing members).

The brushless motors 20 are driven to rotate on the basis of control signals from a controller 60 (hardware processor, shown in FIG. 3), and rotate, by their rotations, their corresponding drive rollers 101. In order for each brushless motor 20 and its corresponding drive roller 101 to rotate by being linked, a component that transmits rotation, such as a belt or a gear, may be provided between their shafts. The control signals are for controlling the rotational speeds of the drive rollers 101. Each brushless motor 20 includes a drive circuit, a stator, a rotor and a rotor rotation detector that defects rotation of the rotor. The drive circuit rotates the rotor by outputting to the stator a current signal of a phase corresponding to a rotational phase obtained from the rotor rotation detector. Also, the drive circuit compares a rotational speed corresponding to a change in the rotational phase detected by the rotor rotation detector with a predetermined set rotational speed (set speed), and adjusts the magnitude of current such that the rotational speed becomes close to the set rotational speed (first control to adjust the rotational speed, i.e., control to be a constant (certain range of) speed). As the current is larger, the torque is larger, which can rotate the rotor faster. The magnitude of current for a speed differs according to the load of the target to rotate (drive roller 111, 121 or 131 in this embodiment). The brushless motors 20 each output current that provides torque necessary to achieve a desired rotational speed, and hence are less likely to consume large power as compared with stepping motors.

The recording medium detector 30 is located upstream of the roller pair 11, which is located, among the three roller pairs 11, 12, 13, farthest upstream in the conveyance direction. The recording medium detector 30 is, for example, an optical sensor capable of detecting whether a recording medium M is present, and detects and outputs to the controller 60 the intensity or the like of incident light, the wavelength of which may be limited. The recording medium detector 30 may be one capable of irradiating a recording medium M with light of a predetermined intensity and detecting whether reflected light from the recording medium M is present. The controller 60 can determine that the top edge of a recording medium M has passed through a detection position (specific position) of the recording medium detector 30 at the timing when a recording medium M undetected state has changed to a recording medium M detected state. A reference based on which it is determined whether a recording medium M has been detected may be changed by the controller 60 depending on the type or the like of the recording medium M.

The imagers 50 are a first imager 51 and a second imager 52. The first imager 51 images the front side (upper side in FIG. 2) of each recording medium M, and the second imager 52 images the back side (lower side in FIG. 2) of each recording medium M. The first imager 51 and the second imager 52 are line sensors in each of which imaging elements are arranged in a direction intersecting with (in this embodiment, perpendicular to) the conveyance direction, and each image, at proper intervals, a recording medium M being conveyed, thereby two-dimensionally reading both sides of the recording medium M. Although not particularly limited, the imaging area (reading area) of the first imager 51 is located between the roller pair 11 and the roller pair 12, and the imaging area of the second imager 52 is located between the roller pair 12 and the roller pair 13. As described later, if the conveying speed of recording media M is not constant (uniform), temporal imaging intervals are adjusted such that spatial imaging intervals become uniform, as needed.

A background plate 53 is disposed to face the first imager 51 with the conveyance path FR in between, and a background plate 54 is disposed to face the second imager 52 with the conveyance path FR in between. These background plates 53, 54 serve as reading references for the first and second imagers 51, 52, respectively, and may be flat white plates.

FIG. 3 is a block diagram showing a functional configuration of the reading apparatus 1 of this embodiment.

The reading apparatus 1 includes the brushless motors 20, the recording medium detector 30 and the imagers 50, which are described above, and motor operation detectors 40 (operation detectors), the aforementioned controller 60 and a communication unit 70.

The motor operation detectors 40 are a first detector 41, a second detector 42 and a third detector 43 respectively for the first motor 21, the second motor 22 and the third motor 23.

The motor operation detectors 40 detect, for example, the rotational speeds of the drive rollers 101 and the torques of the brushless motors 20. The rotational speeds are based on the detection results of the rotor rotation detectors of the brushless motors 20, and torque measurers may be provided between the rotors of the brushless motors 20 and shafts that the rotors rotate. The output currents themselves may be obtained as the torques (values corresponding to the torques).

The controller 60 is a computer that controls overall operation of the reading apparatus 1. The controller 60 includes a CPU 61 and a storage 62.

The CPU 61 is a hardware processor that performs arithmetic processing and controls operation of the above-described components. There may be one CPU 61, or two or more CPUs to perform processes in parallel. If there are two or more CPUs, they may include a CPU dedicated to image processing of imaging data (read data) obtained by the imagers 50.

The storage 62 may include a volatile memory (RAM) and a nonvolatile memory. The volatile memory provides the CPU 61 with a memory space for working and stores temporary data. Examples of the temporary data may include unprocessed image data and image data in process obtained from the imagers 50. The nonvolatile memory stores a program 621 and data of reference values 622. The reference values 622 are, as described later, data each used for determining whether a condition to switch types of control is satisfied, in a conveying operation control process. The nonvolatile memory may also store/keep processed image data together with imaging information or the like. The nonvolatile memory may include an HDD (Hard Disk Drive) or the like in addition to or instead of a flash memory or the like.

The communication unit 70 controls data transmission and reception (communications) with external electronic apparatuses or the like in accordance with predetermined communication standards. The communication standards may include, for example, TCP/IP communications via a LAN (Local Area Network), wireless communications via a wireless LAN and/or Bluetooth®, and/or one-to-one communications with an external apparatus via a USB (Universal Serial Bus) or the like.

The reading apparatus 1 may include, in addition to the above-described components, an operation receiver and a display to receive input operations from a user or the like and display, for example, the status of the reading apparatus 1 and a menu of items selectable with the operation receiver. The operation receiver may include, for example, a touch-screen, a numeric keypad and a power switch. The display may include, for example, a liquid crystal display and an LED lamp(s) of one or more colors. The reading apparatus 1 may be capable of using the operation receiver 94 and the display 94 via the controller 91 of the image forming apparatus 2.

Next, a conveying operation to convey a recording medium(s) M in the reading apparatus 1 of this embodiment will be described.

A recording medium M supplied to the reading apparatus 1 is conveyed by (being laid across) the roller pairs 11, 12, 13, simultaneously at some points, thereby moving downstream in the conveyance direction. At the time, operations of the brushless motors 20 are controlled such that the roller pairs located farther downstream in the conveyance direction rotate faster. This prevents recording media M from bending.

Figure 4A:
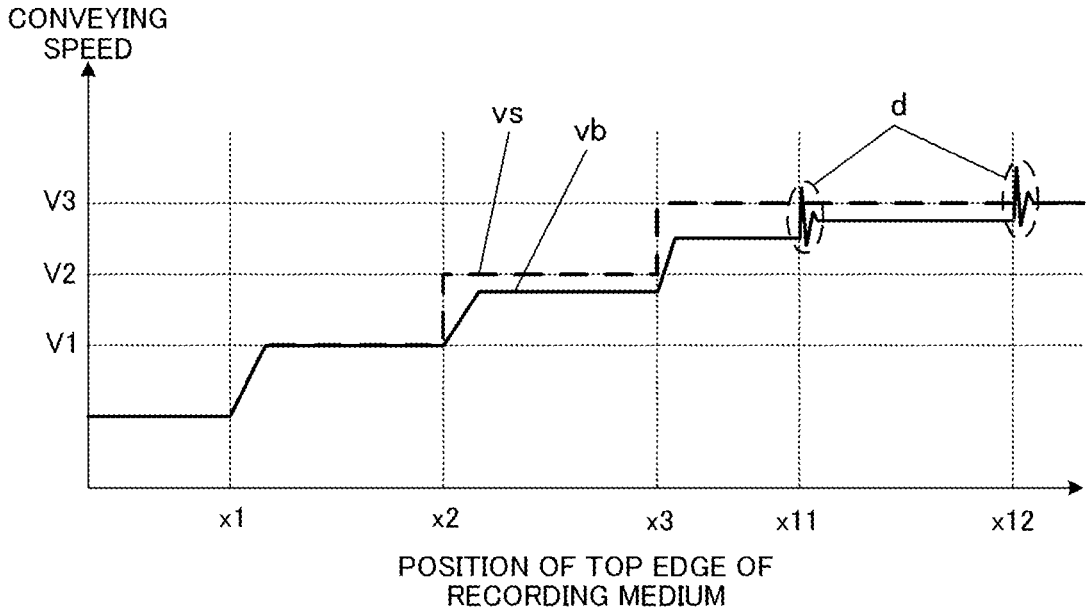
FIG. 4A is an illustration to explain the position of a recording medium and the conveying speed of the recording medium.
Figure 4B:
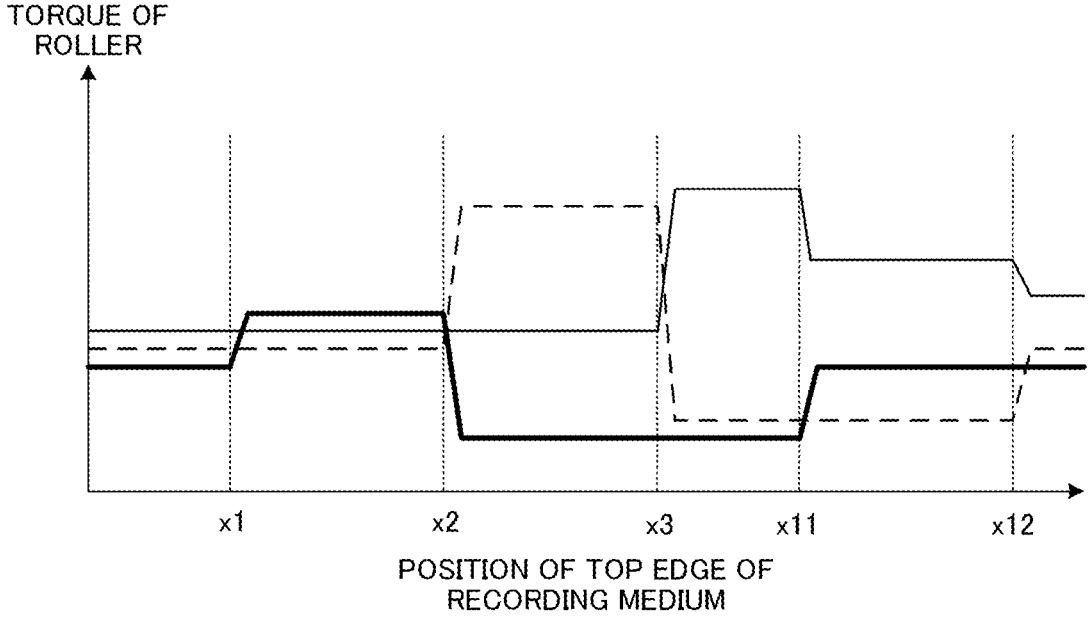
FIG. 4B is an illustration to explain the position of the recording medium and the torque of each brushless motor.

FIG. 4A and FIG. 4B are illustrations to explain the position of a recording medium M, the conveying speed of the recording medium M and the torque of each brushless motor 20.

As shown in FIG. 4A, the roller pairs 11, 12, 13 hold a recording medium M by sandwiching it between their respective rollers at holding positions x1, x2, x3, respectively. The first motor 21 is set to rotate the drive roller 111 at a set speed V1, the second motor 22 is set to rotate the drive roller 121 at a set speed V2, and the third motor 23 is set to rotate the drive roller 131 at a set speed V3. For the sake of explanation, the set speeds V1, V2, V3 shown in FIG. 4A are obviously different from one another, but their actual difference may be minute. A recording medium M leaves the holding position x1 of the roller pair 11 when the position of the top edge (farthest downstream end) of the recording medium M in the conveyance direction is a position x11, and leaves the holding position x2 of the roller pair 12 when the position of the top edge of the recording medium M in the conveyance direction is a position x12. As described above, the first control is performed by comparing the actual rotational speed with the set speed and adjusting current such that the actual rotational speed becomes close to the set speed.

When a recording medium M being conveyed by the drive roller 101 of a certain roller pair reaches the holding position of a downstream roller pair located downstream of the certain roller pair, the recording medium M receives tension from both the downstream roller pair and the certain roller pair as an upstream roller pair that rotates slower than the downstream roller pair. At the time, the brushless motors 20 exhibit different characteristics from conventional stepping motors. In the case of stepping motors, unless they lose steps, both the upstream roller pair and the downstream roller pair rotate at their rotational speeds set for their drive rollers. As a result, in accordance with the magnitude of the sandwiching-and-holding force of each roller pair, the recording medium M moves, for example, at the rotational speed (vs) of the downstream roller pair, the sandwiching-and-holding force of which is larger, and slips against the upstream roller pair, which results in "vs". In contrast, in the case of the brushless motors 20, the recording medium M does not slip against any of the roller pairs. Instead, the downstream drive roller 101 and the brushless motor 20 therefor are deaccelerated according to increase in the load, and the upstream drive roller 101 and the brushless motor 20 therefor are accelerated, which results in "vb".

As shown in FIG. 4B, the output torque (current value) of the first motor 21 to the drive roller 111, which is located farthest upstream and indicated by a thick solid line, increases by the roller pair 11 holding a recording medium M in between changed from the state of receiving no load from the recording medium M. Thereafter, when the top edge of the recording medium M reaches the holding position x2 of the roller pair 12, the recording medium M is pulled by the drive roller 121 at a higher speed, and this recording medium M increases the rotational speed of the drive roller 111, and accordingly the first motor 21 can rotate with a smaller torque for the rotational speed.

The output torque (current value) of the second motor 22 to the drive roller 121 indicated by a broken line is, from the beginning, slightly larger than that of the first motor 21 because the rotational speed of the second motor 22 is faster than that of the first motor 21. In FIG. 4B, the difference is shown largely for the sake of explanation. When the top edge of the recording medium M reaches the holding position x2 of the roller pair 12, the second motor 22 carries (takes) not only the load to rotate the drive roller 121 to convey the recording medium M but also the load to increase the rotational speed of the first motor 21 and the drive roller 111, which rotate slower than the second motor 22, so that the output torque of the second motor 22 greatly increases. When the top edge of the recording medium M reaches the holding position x3 of the roller pair 13, the recording medium M is pulled by the drive roller 131 at a further higher speed, and this recording medium M increases the rotational speed of the drive roller 121, and accordingly the second motor 22 can rotate with a smaller torque for the rotational speed.

The output torque (current value) of the third motor 23 to the drive roller 131 indicated by a thin solid line is, in the state in which the roller pair 13 holds and conveys no recording medium M, slightly larger than that of the second motor 22 in the same state. When the top edge of the recording medium M reaches the holding position x3 of the roller pair 13, the third motor 23 carries, in addition to the load to convey the recording medium M, the loads to increase the rotational speeds of the first motor 21 and the second motor 22, so that the output torque of the third motor 23 greatly increases. When the top edge of the recording medium M reaches the position x11 and the bottom edge of the recording medium M leaves the holding position x1 of the roller pair 11 accordingly, the third motor 23 does not carry any longer, among the aforementioned loads, the load to increase the rotational speed of the first motor 21, so that the output torque of the third motor 23 slightly decreases. When the top edge of the recording medium M reaches the position x12 and the bottom edge of the recording medium M leaves the holding position x2 of the roller pair 12 accordingly, the third motor 23 does not carry any longer the load to increase the rotational speed of the second motor 22 either, so that the output torque of the third motor 23 further decreases.

Thus, in the case where a recording medium M is conveyed by being laid across two or more roller pairs, although a downstream brushless motor 20 of a higher speed, for example, the second motor 22, tries to convey the recording medium M at the set speed V2, it is affected by the operation of an upstream brushless motor 20 of a lower speed, for example, the first motor 21, and hence the set speed V2 cannot achieved. As a result, feedback is applied to the second motor 22 to increase its torque. Meanwhile, the rotational speed of the upstream first motor 21 increases by the recording medium M that is being conveyed at a higher speed than the set speed V1 by the operation of the second motor 22. As a result, feedback is applied to the first motor 21 to reduce its torque. That is, control is performed to widen the difference between the torque of the second motor 22 and the torque of the first motor 21.

If such a state continues, work efficiency decreases. Further, if the difference between the loads of the brushless motors 20 is large as described above, when a recording medium M is conveyed and leaves the holding area of the upstream roller pair 11, the load being applied from the upstream roller pair 11 and first motor 21 to the downstream second motor 22 via the recording medium M disappears at once, the downstream second motor 22 being mainly applying force to the recording medium M in the conveyance direction, and a significantly large force is applied to the recording medium M temporarily. As a result, the conveying speed of the recording medium M greatly fluctuates (range d in FIG. 4A). When the recording medium M leaves the holding area of the roller pair 12, the load being applied from the second motor 22 and the roller pair 12 to the third motor 23 disappears. As a result, the conveying speed greatly fluctuates (range d in FIG. 4A). When the conveying speed fluctuates, a point on the recording medium M being imaged at the timing cannot be identified, and reading accuracy decreases. Hence, use of the brushless motors 20 for conveying recording media M requires control different from use of stepping motors requires.

The reading apparatus 1 of this embodiment switches between and performs control based on the normal rotational speed (first control) and control based on the torque (or output current, the same applies hereinafter to the descriptions about the torque-based control) (second control, i.e., control to be a constant (certain range of) torque), depending on the operating state of each brushless motor 20 (drive roller 101). More specifically, if the torque of each brushless motor 20 is out of its predetermined reference range (predetermined torque range), the reading apparatus 1 switches to and performs control to normalize the torque, namely, to give priority to the torque falling within the reference range.

Figure 5A:
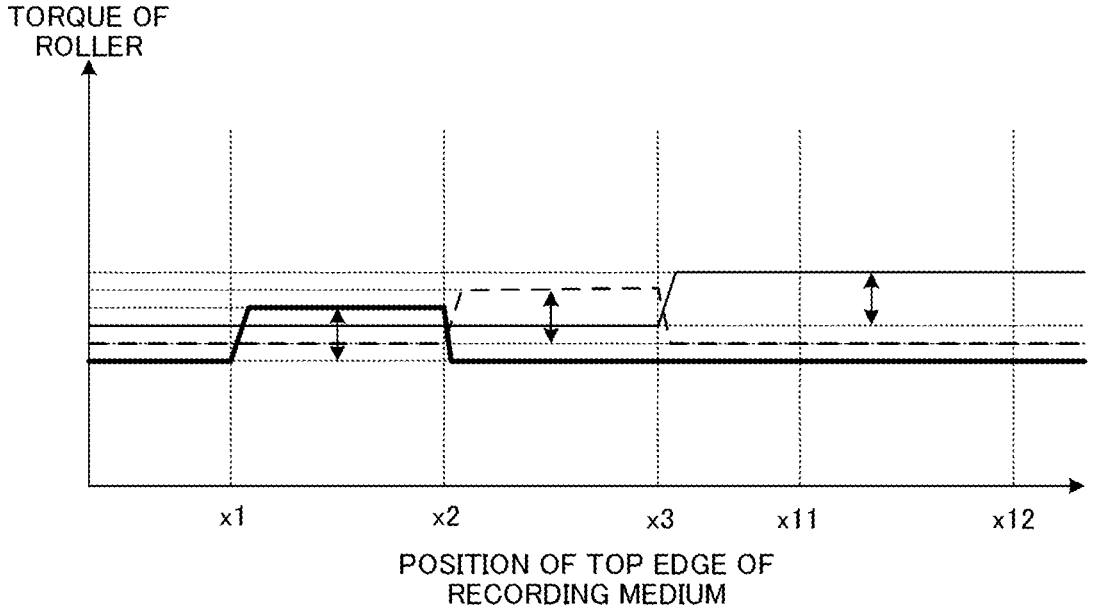
FIG. 5A is an illustration to explain adjustment of the torque.
Figure 5B:
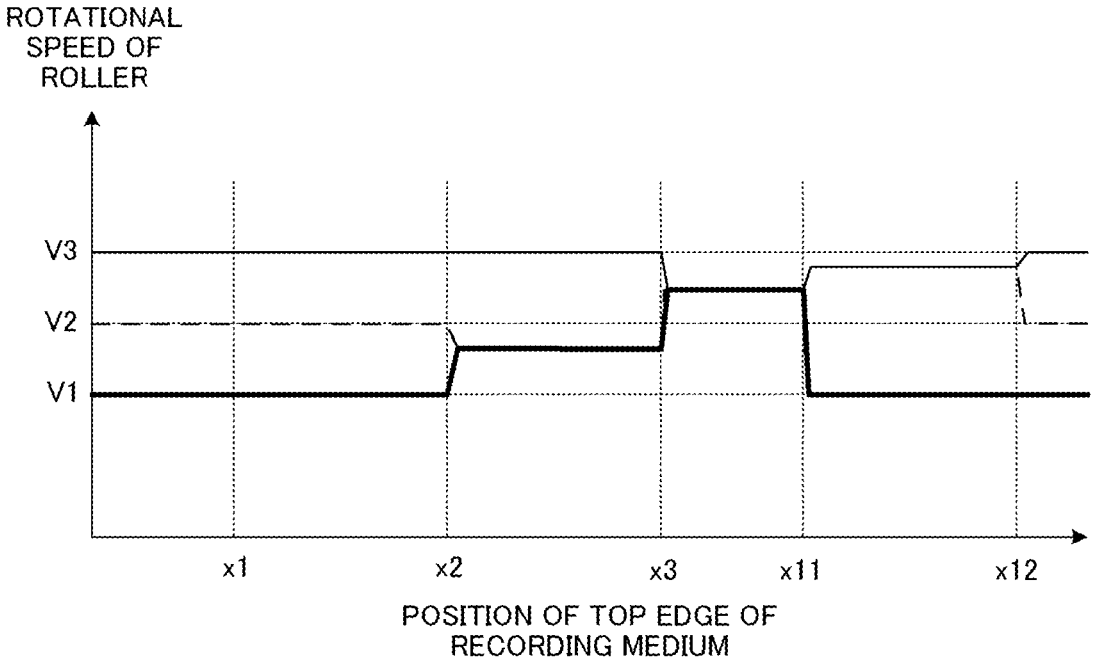
FIG. 5B is another illustration to explain adjustment of the torque.

FIG. 5A and FIG. 5B are illustrations to explain adjustment of the torque.

The lower limit of the reference range (predetermined torque range) may be set, for example, at the torque of each brushless motor 20 in the state in which its corresponding roller pair holds no recording medium M in between. As shown in FIG. 5A, an abrupt decrease in the load of a target brushless motor 20 is curbed. The abrupt decrease could occur at the timing when the target brushless motor 20 that rotates its corresponding drive roller 101 does not rotate any longer a drive roller 101 located farthest upstream. Thus, each brushless motor 20 at least generates by itself the torque necessary to rotate its corresponding drive roller 101 at a set rotational speed, and does not cause another brushless motor 20 that rotates a drive roller 101 located downstream to carry it unnecessarily. That is, a significant increase in the torque of a downstream brushless motor 20 is also curbed.

The torque necessary for the downstream brushless motor 20 corresponds to the sum of the load to rotate its corresponding drive roller 101 and, as additional loads, the load to convey a recording medium M at the actual conveying speed and the load necessary to increase the rotation of the upstream brushless motor 20 from its set speed to the conveying speed. Hence, the upper limit of the reference range may be set, for example, at the torque of each brushless motor 20 in the state in which its corresponding roller pair alone holds a recording medium M in between. In this case, the recording medium M is conveyed in the state in which the rotational speed of the downstream brushless motor 20 decreases from its set speed by the amount corresponding to the aforementioned additional loads. Raising the upper limit of the reference range may curb decrease in the conveying speed of the recording medium M.

That is, the reference range of torque for each brushless motors 20 may be determined to be slightly wider (mainly upward) than the range(s) indicated by a double arrow(s) in FIG. 5A corresponding to cases where a recording medium M is present and absent and, if present, conveyed by its corresponding roller pair alone, namely, with operations of the other brushless motors 20 not taken into account. This reduces variation between the torques of the brushless motors 20, and also curbs a large change in the load being applied to a downstream roller pair when a recording medium M leaves the holding position of an upstream roller pair. For example, the torque of the third motor 23 does not change at the positions x11, x12 because disappearance of the loads for the roller pairs 11, 12 respectively at the positions x11, x12 is substantially offset by increase in the conveying speed. Thus, a large fluctuation in the conveying speed is curbed, and decrease in reading accuracy is curbed. The reference ranges may be stored in the storage 62 in advance as the reference values 622.

The magnitude of the load to convey a recording medium M depends on the material and size of the recording medium M, environmental conditions and so forth. Hence, it is difficult to determine the same reference range(s) of torque for every recording medium M. That is, if the torque control is always the same, the conveying speed could greatly deviate from the set speed, depending on the recording medium M being conveyed. Hence, if there is a brushless motor 20 out of a set speed range during the torque control, the control is returned to the rotational speed control (first control) as to that brushless motor 20 at least. The set speed range may be determined, for example, by adding a predetermined width to the set speed. The upper limit of the set speed range for a certain brushless motor 20 is lower than the set speed of a downstream brushless motor 20 that rotates a drive roller 101 located downstream of a drive roller 101 that the certain brushless motor 20 rotates, and the lower limit thereof is higher than the set speed of an upstream brushless motor 20 that rotates a drive roller 101 located upstream of the drive roller 101 that the certain brushless motor 20 rotates. If the first control causes the magnitude of the torque to be out of the reference range again, the control may be simply returned to the torque control, or may be returned to the torque control after the set reference range of torque is corrected to a reference range for this state.

As shown in FIG. 5B, the actual rotational speeds of the drive rollers 101 are based on the set speed V1, V2 or V3 of a brushless motor 20 for a roller pair located farthest downstream among roller pairs that are conveying a recording medium M and slightly lower than the set speed V1, V2 or V3 while the recording medium M is being held by an upstream roller pair(s) too.

As described above, the torque of a certain brushless motor 20 increases as the torque of a brushless motor 20 for an upstream roller pair, which is located upstream of a roller pair that the certain brushless motor 20 rotates, decreases. Hence, if the lower limit of the torque of a brushless motor 20 for an upstream roller pair is determined, the torque of a brushless motor 20 for a downstream roller pair does not increase unnecessarily. Hence, the torque-based current control may not be performed on the third motor 23 for the roller pair 13, which is located farthest downstream. In this case, the third motor 23 is controlled such that the rotational speed is always equal to the set speed.

Figure 6:
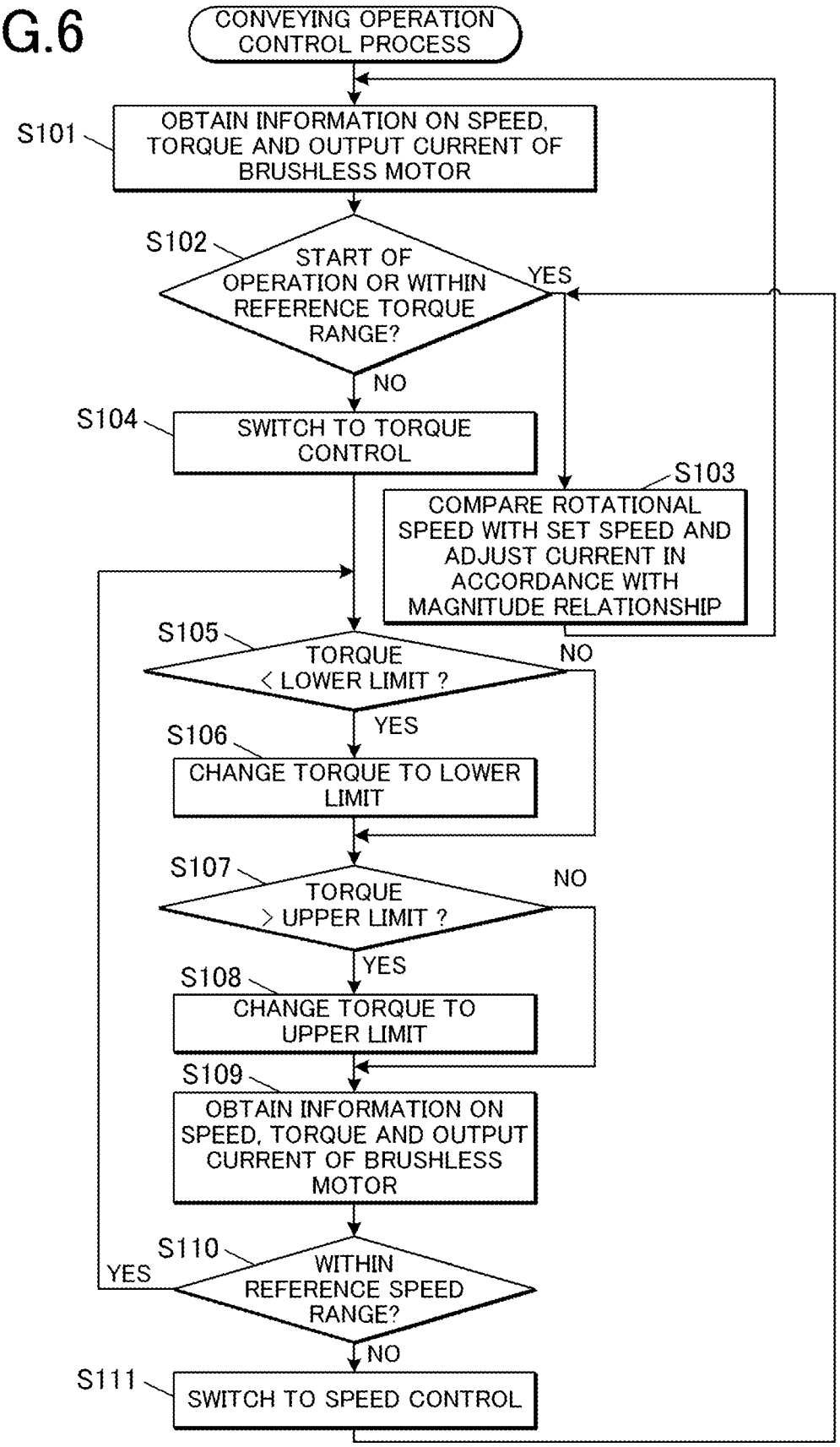
FIG. 6 is a flowchart showing a control procedure of a conveying operation control process that is performed by the reading apparatus according to the embodiment.

FIG. 6 is a flowchart showing a control procedure of the conveying operation control process that is performed by the reading apparatus 1 of this embodiment.

The conveying operation control process is performed by the controller 60, but may be performed in part by control circuits (hardware processors) included in the drive circuits in the brushless motors 20. The conveying operation control process is performed on each brushless motor 20. The conveying operation control process is started at the start of the conveying operation, and forcibly terminated by an interrupt operation or the like in response to an order to end or stop/suspend the conveying operation.

When the conveying operation control process is started, the controller 60 detects information on the rotational speed, torque and output current (intensity thereof) of each brushless motor 20 from its corresponding motor operation detector 40 (Step S101). If, as described above, the torque is not measured directly, a torque measurement result is not included in the obtained contents. The controller 60 determines whether it is the start of operation or the torque is within the reference range (Step S102). The "start of operation" herein indicates, for example, from the state in which a brushless motor 20 and its corresponding drive roller 101 are not rotating with no output current (output current of zero) until the rotational speed reaches the set speed once, until the torque reaches the reference range once, or until a predetermined period of time within which the rotational speed normally reaches the set speed elapses. If the controller 60 determines that it is the start of operation or the torque is within the reference range (Step S102; "YES"), the controller 60 performs the first control by comparing the obtained rotational speed with the set rotational speed (set speed) and adjusting current in accordance with their magnitude relationship (Step S103). That is, if the rotational speed is higher than the set speed, the controller 60 reduces the current, whereas if the rotational speed is lower than the set speed, the controller 60 increases the current. The controller 60 then returns to Step S101.

In Step S102, if the controller 60 determines that it is not the start of operation (e.g., it is after the rotational speed of the brushless motor 20 increases to a predetermined set speed) and also the torque is not within the reference range (Step S102; "NO"), the controller 60 changes its control to the torque-based current control (second control) (Step S104). The controller 60 determines whether the torque is smaller than the lower limit (Step S105). If the controller 60 determines that the torque is smaller than the lower limit (Step S105; "YES"), the controller 60 increases the output current to increase the torque to the lower limit (Step S106). The controller 60 then proceeds to Step S107. If the controller 60 determines that the torque is not smaller than the lower limit (Step S105; "NO"), the controller 60 proceeds to Step S107.

In Step S107, the controller 60 determines whether the torque is larger than the upper limit (Step S107). If the controller 60 determines that the torque is larger than the upper limit (Step S107; "YES"), the controller 60 reduces the output current to reduce the torque to the upper limit (Step S108). The controller 60 then proceeds to Step S109. If the controller 60 determines that the torque is not larger than the upper limit (Step S107; "NO"), the controller 60 proceeds to Step S109.

The processes in Steps S105 to S108 are contents of the second control in the reading apparatus 1 of this embodiment.

In Step S109, the controller 60 obtains information on the rotational speed, torque and output current of the brushless motor 20 (Step S109). The controller 60 determines whether the rotational speed is within the reference range (Step S110). If the controller 60 determines that the rotational speed is within the reference range (Step S110; "YES"), the controller 60 returns to Step S105.

If the controller 60 determines that the rotational speed is not within the reference range (Step S110; "NO"), the controller 60 changes its control to the speed-based current control (first control) (Step S111). The controller 60 then proceeds to Step S103.

The processes in Steps S102, S104, S110 and S111 correspond to a control switching step of the conveying operation control method of this embodiment.

The conveying speed during the second control may be separately stored and used for identifying the position of an image imaged (read) at intervals (imaging intervals), or, conversely, used for adjusting the imaging intervals. Unlike the aforementioned large fluctuation in the conveying speed, changes in the conveying speed during the second control can be detected/identified and hence accurately reflected in the imaging operation, or image reading, namely, do not reduce reading accuracy.

Figure 7:
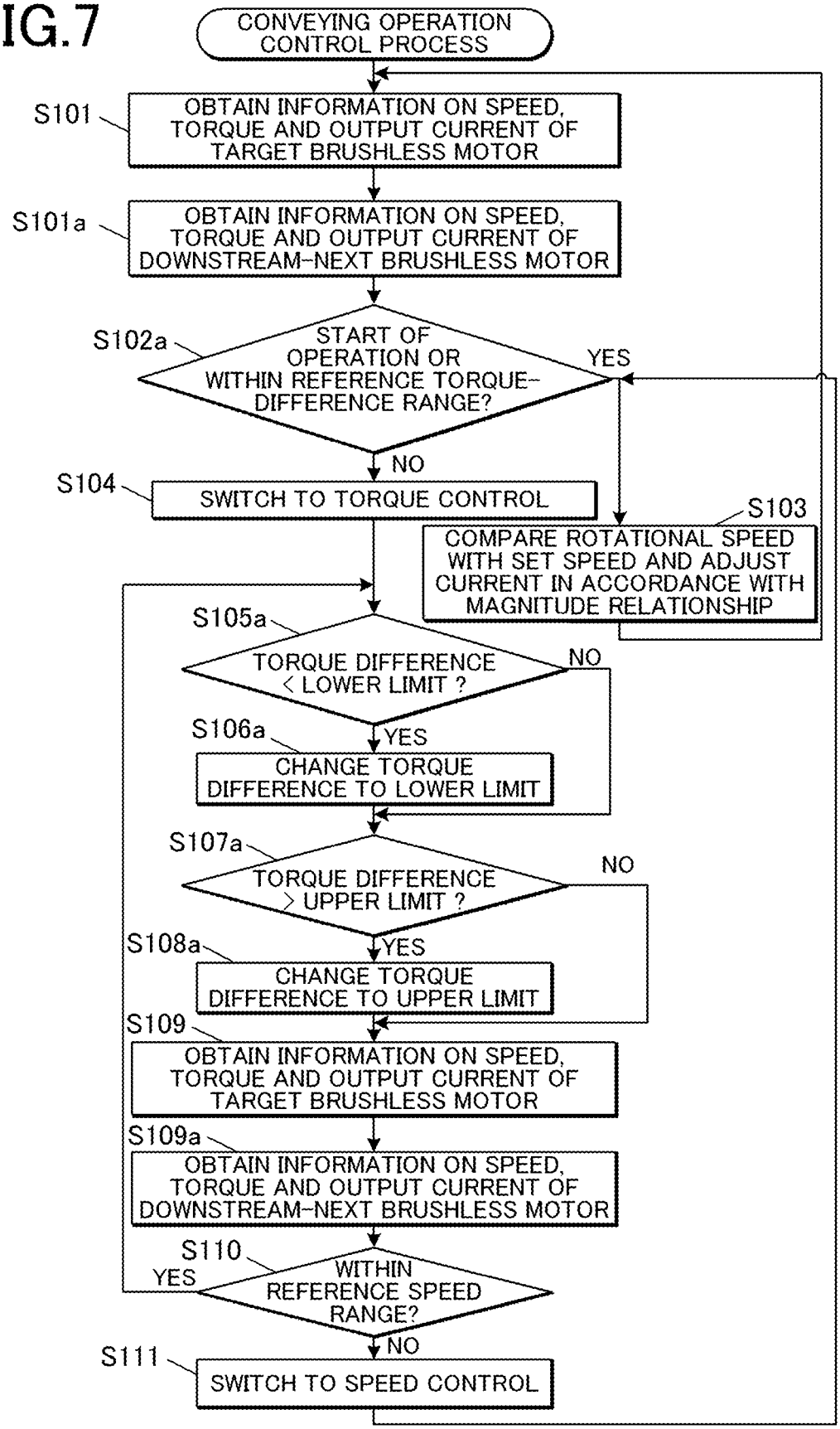
FIG. 7 is a flowchart showing a first modification of the conveying operation control process.

FIG. 7 is a flowchart showing a first modification of the conveying operation control process.

In the above, the control switching is performed with the torque (output current) of each brushless motor 20 as a reference, but may be performed with a difference between the torque of a target brushless motor 20 and the torque of a brushless motor 20 that rotates a drive roller 101 located downstream of and next to (downstream-next drive roller 101) a drive roller 101 that the target brushless motor 20 rotates. The reference range(s) of torque difference may include a magnitude relationship (sign). The reference range (s) of torque difference is different from the reference range(s) of torque magnitude in the above embodiment and stored in advance as the reference values 622.

The conveying operation control process of the first modification is the same as that of the above embodiment except that Steps S101*a* and S109*a* are added, and Steps S102*a*, S105*a* to S108*a* replace Steps S102, S105 to S108, respectively. The other steps are the same as those of the above embodiment, and hence their detailed descriptions will be omitted by giving the same step numbers.

After Step S101, the controller 60 obtains the rotational speed, torque and output current of a brushless motor 20 (downstream-next brushless motor 20) that rotates a downstream-next drive roller 101, from its corresponding motor operation detector 40 (Step S101*a*). The controller 60 determines whether it is the start of operation or their torque difference is within the reference range by comparing the torques of the two brushless motors 20 (Step S102*a*). The "torque difference" herein indicates a value of "torque (output current) of target brushless motor 20—torque (output current) of downstream-next brushless motor 20". If the controller 60 determines that it is the start of operation or their torque difference is within the reference range (Step S102*a*; "YES"), the controller 60 proceeds to Step S103. If the controller 60 determines that it is not the start of operation and also their torque difference is not within the reference range (Step S102*a*; "NO"), the controller 60 proceeds to Step S104.

After Step S104, the controller 60 determines whether the torque difference is smaller than the lower limit (Step S105*a*). The "lower limit" herein is a negative value. If the controller 60 determines that the torque difference is smaller than the lower limit (Step S105*a*; "YES"), the controller 60 changes the output current of the target brushless motor 20 to make the torque difference the lower limit (Step S106*a*). The controller 60 then proceeds to Step S107*a*. If the controller 60 determines that the torque difference is not smaller than the lower limit (Step S105*a*; "NO"), the controller 60 proceeds to Step S107*a*.

In Step S107*a*, the controller 60 determines whether the torque difference is greater than the upper limit (Step S107*a*). The "upper limit" herein is also a negative value. If the controller 60 determines that the torque difference is greater than the upper limit (Step S107*a*; "YES"), the controller 60 changes the output current of the target brushless motor 20 to make the torque difference the upper limit (Step S108*a*). The controller 60 then proceeds to Step S109. If the controller 60 determines that the torque difference is not greater than the upper limit (Step S107*a*; "NO"), the controller 60 proceeds to Step S109.

After Step S109, the controller 60 obtains the rotational speed, torque and output current of the brushless motor 20 (downstream-next brushless motor 20) that rotates the downstream-next drive roller 101 from its corresponding motor operation detector 40 (Step S109*a*). The controller 60 then proceeds to Step S110.

The torque difference between two brushless motors 20 is totally different depending on whether the downstream-next drive roller 101 is the farthest-downstream drive roller 101 among drive rollers 101 that are conveying a recording medium M. Hence, the reference range (upper limit and lower limit) may be determined for each combination of brushless motors 20.

Figure 8:
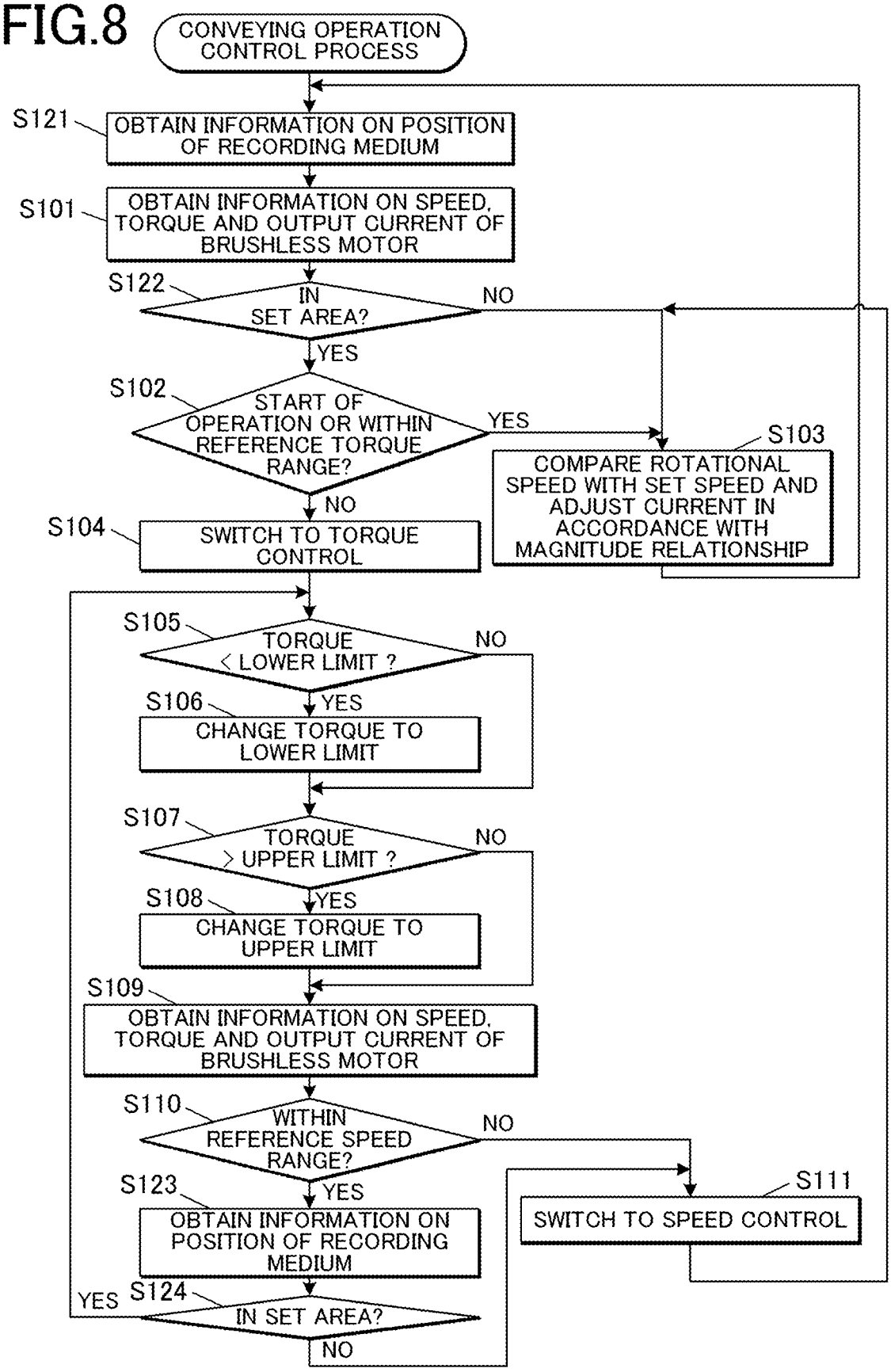
FIG. 8 is a flowchart showing a second modification of the conveying operation control process.

FIG. 8 is a flowchart showing a second modification of the conveying operation control process.

The control switching may be performed in accordance with the position of a recording medium M such that the torque-based output-current control (second control) is performed only when the recording medium M is positioned across two or more of the roller pairs 11, 12, 13. The position of a recording medium M (until it reaches the holding position x2 of the roller pair 12) is calculated and identified, for example, from the timing when the recording medium detector 30 detects the top edge (farthest-downstream end) of the recording medium M, by integrating the rotational speed of the first motor 21. When and after the top edge of the recording medium M reaches and passes through the holding position x2 of the roller pair 12, the position of the recording medium M is calculated and identified by integrating and adding the rotational speed of the farthest-downstream roller pair among roller pairs that are holding the recording medium M. Alternatively, more simply, another recording medium detector may be provided downstream of the position x12 to detect the end of the state in which the recording medium M is positioned across two or more of the roller pairs 11, 12, 13.

A set area where the torque control is performed may be predetermined for each target brushless motor 20.

The conveying operation control process of the second modification, in which the set area(s) is provided, is the same as that of the above embodiment except that Steps S121 to S124 are added. The other steps are the same as those of the above embodiment, and hence their detailed descriptions will be omitted by giving the same step numbers.

When the conveying operation control process is started, the controller 60 obtains information on the position of a recording medium M (Step S121). As described above, the position of a recording medium M is obtained from the timing at which the recording medium detector 30 detects the top edge of the recording medium M and the integral value of the conveying speed of the recording medium M. The position of a recording medium M may be obtained by a separate process from the conveying operation control process, or identified by the controller 60 in Step S121, in which the controller 60 obtains the aforementioned information.

After Step S101, the controller 60 determines whether the position of the recording medium M is in the set area (Step S122). If the controller 60 determines that the position of the recording medium M is not in the set area (Step S122; "NO"), the controller 60 proceeds to Step S103. If the controller 60 determines that the position of the recording medium M is in the set area (Step S122; "YES"), the controller 60 proceeds to Step S102.

If Step S110 is "YES", the controller 60 obtains information on the position of the recording medium M (Step S123). Step S123 is the same as Step S121 in detail.

The controller 60 then determines whether the current position of the recording medium M is in the set area (Step S124). If the controller 60 determines that the current position of the recording medium M is in the set area (Step S124; "YES"), the controller 60 returns to Step S105. If the controller 60 determines that the current position of the recording medium M is not in the set area (Step S124; "NO"), the controller 60 proceeds to Step S111.

As described above, the reading apparatus 1 of the embodiment includes the imager(s) 50 that reads the surface (front side and back side) of a recording medium M with an image(s) formed by the image forming apparatus 2, the conveyor 10 that includes the drive rollers 101 disposed along the conveyance path FR that passes through the reading area(s) of the imager(s) 50, and conveys the recording medium M being laid across at least two of the drive rollers 101, the brushless motors 20 that rotate the drive rollers 101, and the controller 60 (which may include the control circuits included in the drive circuits in the brushless motors 20 that may perform part of the aforementioned processes of the determination steps and control steps). The controller 60 controls operations of the brushless motors 20 such that the drive rollers 101 located farther downstream in the conveyance direction of the recording medium M rotate faster, and as to at least one brushless motor 20 of the brushless motors 20, switches between and performs the first control to adjust the rotational speed and the second control to adjust the torque, depending on the operating state of the brushless motor 20.

The torque (output current) of each brushless motor 20 is usually controlled to achieve the set speed, but there are cases where force is transmitted between drive rollers 101 via a recording medium M, and improper feedback is applied. Giving priority to and determining the torques of the brushless motors 20 according to their respective operating states makes it possible to adjust the output currents of the brushless motors 20 such that the brushless motors 20 operate stably in a balanced fashion with their torques not greatly deviating from their original torques. Hence, the reading apparatus 1 can perform the conveying operation efficiently while curbing decrease in reading accuracy. Also, the reading apparatus 1 can prevent, when a recording medium M leaves the holding position of a drive roller 101, occurrence of a large change in the load of a brushless motor 20 that rotates another drive roller 101 and occurrence of a large fluctuation in the conveying speed of the recording medium M accordingly. Hence, the reading apparatus 1 can perform the imaging operation with the imagers 50 properly while moving recording media M at a stable speed.

Further, the controller 60 performs the first control to control the brushless motor 20 such that the rotational speed becomes a predetermined rotational speed. That is, each brushless motor 20 is controlled to rotate at a constant speed. This can reduce variation in the conveying speed, and enables the imagers 50 to perform stable reading.

Further, the controller 60 performs the second control to control the brushless motor 20 such that the torque falls within a predetermined reference range. This can reduce occasions where a brushless motor 20 that rotates an upstream drive roller 101 from causing a brushless motor 20 that rotates a downstream drive roller 101 to carry the load that the former requires for itself and its corresponding drive roller 101, namely, the upstream drive roller 101, to rotate. Further, since brushless motors 20 can be controlled separately, the second control is easy.

Further, in response to the torque of the brushless motor 20 being out of the predetermined reference range under the first control, the controller 60 switches to the second control as to the operation of the brushless motor 20. If the conveying speed control (first control) widens the difference between the torque of a brushless motor 20 and the torque of another brushless motor 20 again, the controller 60 returns to the torque control (second control). This enables the brushless motors 20 to efficiently operate in a balanced fashion.

Further, the controller 60 performs the second control such that the difference between the torque of the brushless motor 20 as a control target and the torque of a brushless motor 20 that rotates a drive roller 101 located, in the conveyance direction, downstream of a drive roller 101 that the brushless motor 20 as the control target rotates falls within a predetermined reference difference range. This can prevent a brushless motor 20 that rotates a downstream drive roller 101 from carrying, more than necessary, the torque of a brushless motor 20 that rotates an upstream drive roller 101 and prevent the conveying operation from being unbalanced accordingly.

Further, in response to the difference between the torque of the brushless motor 20 as a control target and the torque of a brushless motor 20 that rotates a drive roller 101 located, in the conveyance direction, downstream of a drive roller 101 that the brushless motor 20 as the control target rotates being out of a predetermined reference difference range, the controller 60 switches to the second control as to the operation of the brushless motor 20 as the control target.

Switching to the conveying speed control causes, as its principle, adjustment to widen the difference between the torque (output current) of a brushless motor 20 and the torque (output current) of another brushless motor 20 again as described above. Returning to the torque control can resolve unbalanced inefficient operations of the brushless motors 20.

Further, in response to the rotational speed of the brushless motor 20 being out of a predetermined set speed range under the second control, the controller 60 switches to the first control as to the operation of the brushless motor 20. The torque control only may make the rotational speed greatly deviate from the set speed, depending on the type, condition and/or the like of a recording medium M being conveyed. Performing the speed adjustment at appropriate timings can make the conveying operation more accurate.

Further, the controller 60 performs the first control when the drive roller 101 corresponding to the brushless motor 20 starts to rotate, and switches to the second control after the rotational speed of the drive roller 101 increases to a predetermined set speed. That is, after the conveying speed is once increased to around the set speed, the torque is kept stable by the second control. This enables efficient control of the conveying operation.

Further, the reading apparatus 1 includes the recording medium detector 30 that detects the recording medium M at a specific position, wherein the controller 60 identifies the position of the recording medium M based on the result of the detection by the recording medium detector 30, and switches between the first control and the second control in accordance with the identified position.

The area where a recording medium M is positioned that causes a significant imbalance in torque between brushless motors 20 is limited in general. Hence, determining whether the position of a recording medium M satisfies such a condition and performing the control to give priority to the torque when needed only makes it easy to keep the conveying speed at the set speed.

Further, the reading apparatus 1 includes the driven rollers 102 corresponding to the drive rollers 101, the driven rollers 102 rotating as their corresponding drive rollers 101 rotate. A recording medium M is conveyed by being sandwiched between and held by the drive rollers 101 and the driven rollers 102 of upstream and downstream roller pairs while they are rotated, and hence the recording medium M is surely pulled both upstream and downstream. This prevents recording media M from bending. Further, recording media M and the driven rollers 102 as pressing members do not slide against one another. This reduces an adverse influence on the surface of recording media M. Still further, friction of recording media M by the conveying operation is small. This curbs increase in the rotational torques of the drive rollers 101.

The first, second and third motors 21, 22, 23 may be the brushless motors 20. Even if they are not the brushless motors 20, the conveying operation of the present disclosure is appropriately controlled unless they are stepping motors. However, using the brushless motors 20 can especially reduce the size of the conveyor 10 and improve durability of the conveyor 10.

Further, the conveying operation control method for the reading apparatus 1 of the embodiment includes, as to at least one brushless motor 20 of the brushless motors 20, switching between and performing the first control to adjust the rotational speed and the second control to adjust the torque, depending on the operating state of the brushless motor 20 (control switching step), wherein the set speeds of the brushless motors 20 are determined such that the drive rollers 101 located farther downstream in the conveyance direction of a recording medium M with an image(s) formed rotate faster. This conveying operation control method makes it possible to adjust the output currents of the brushless motors 20 such that the brushless motors 20 operate stably in a balanced fashion with their torques not greatly deviating from their original torques. Hence, the conveying operation control method enables the reading apparatus 1 to perform the conveying operation efficiently while curbing decrease in reading accuracy. Also, the conveying operation control method can prevent, when a recording medium M leaves the holding/conveying position of a drive roller 101, occurrence of a large change in the load of a brushless motor 20 that rotates another drive roller 101 and occurrence of a large fluctuation in the conveying speed of the recording medium M accordingly. Hence, the conveying operation control method enables the reading apparatus 1 to perform the imaging operation with the imagers 50 properly while moving recording media M at a stable speed.

Further, the storage medium (non-transitory computer-readable storage medium) stores the program 621 that causes the controller 60 as a computer to perform the above-described control switching step. This control by software easily enables the brushless motors 20 to operate in a balanced fashion and enables the conveyor 10 to perform the conveying operation stably and efficiently, and hence enables the imagers 50 to perform the imaging operation more accurately.

The present invention is not limited to the above embodiment or the like, but can be modified in a variety of respects.

For example, in the above embodiment, two imagers 50 are provided to read both sides, namely, the front side and the back side, of each recording medium M by one pass (conveyance), but this is no limitation. Only one side of each recording medium M may be read or may be read by one pass.

Further, in the above embodiment, the reading apparatus 1 reads images formed by the image forming apparatus 2 on recording media M that are the reading target. These images may be three-dimensional, for example, having asperities or the like.

Further, the reading apparatus of the present disclosure is not limited to the one that reads images or the like with visible light. The reading apparatus may be any as far as it requires reading resolution, for example, the one that reads a structure, inside of the structure or the like and uses, as needed, electromagnetic waves of another wavelength(s) therefor.

Further, in the above embodiment, each recording medium M is sandwiched between and held by, for example, the drive roller 111 and the driven roller 112 brought into contact with one another, but not limited thereto. Each recording medium M may be sandwiched between and held by the drive roller 111 and a flat plate. The flat plate may be shared by two or more drive rollers 101. Further, the conveyor 10 may not convey each recording medium M along a straight line. The conveyance path may be curved or bent at some points.

Further, in the above embodiment, the rotational speed of each drive roller 101 is obtained from the rotational speed of its corresponding brushless motor 20, but may be obtained by another method, for example, directly measured by using a rotary encoder.

Further, in the above embodiment, there is provided one recording medium detector 30 that identifies the position of each recording medium M, but the number of recording medium detectors 30 is not limited to one and may be two or more. For example, recording medium detectors 30 may be provided right in front of and/or right behind the respective drive rollers 101.

Further, in the first modification, the torque (output current) of a brushless motor 20 is compared with the torque (output current) of a brushless motor 20 that operates a drive roller 101 adjacent to a drive roller 101 that the former operates, but not limited thereto and may be compared with the torque (output current) of a brushless motor 20 that operates the farthest-downstream drive roller 101 among drive rollers 101 that are conveying a recording medium M.

Further, in the above embodiment, in the second control, if the torque (output current) is out of the reference range, the control is performed to change the torque to the upper limit or the lower limit of the reference range by the output current being changed once. However, if the torque is greatly out of the reference range, the control may be performed to make the torque fall within the reference range by the output current being changed multiple times, with a predetermined width or percentage of change per time.

Further, in the above embodiment, the brushless motors 20 are used, but motors except stepping motors, for example, brush motors, may be used.

Further, in the above embodiment, each recording medium M is conveyed by being sandwiched between and held by the rollers of the respective roller pairs 11, 12, 13, but may not be sandwiched between and held by rollers of roller pairs, as far as the load(s) is shared by two or more drive rollers 101 via a recording medium M that is laid across the drive rollers 101 and is being conveyed thereby, and difference in speed thereof prevents the recording medium M from bending.

Further, in the above, the computer-readable storage medium storing the program 621 for the conveying operation control process of the present disclosure is the storage 62 including a nonvolatile memory, such as an HDD and/or a flash memory, but not limited thereto and may be another nonvolatile memory, such as an MRAM, or a portable storage medium, such as a CD-ROM or a DVD disk. Further, as a medium to provide data of the program(s) of the present disclosure via a communication line, a carrier wave can be used.

Although one or more embodiments or the like of the present disclosure have been described and illustrated in detail, the disclosed embodiments or the like are made for purposes of not limitation but illustration and example only. The specific configurations/components, positional relationships, details and procedures of the processes and so forth described in the above embodiment(s) or the like can be appropriately modified in a range not departing from the scope of the present invention. The scope of the present invention includes that described in claims below and the scope of their equivalents.

What is claimed is:

1. A reading apparatus comprising:

a reader that reads a surface of a recording medium with an image formed;

a conveyor that includes rollers disposed along a conveyance path that passes through a reading area of the reader, and conveys the recording medium being laid across the rollers;

motors that rotate the rollers; and a hardware processor that controls operations of the motors such that the rollers located farther downstream in a conveyance direction of the recording medium rotate faster, and as to at least one motor of the motors, switches between and performs a first control to adjust a rotational speed and a second control to adjust a torque, depending on an operating state of the motor;

wherein the hardware processor performs the second control to control the motor such that the torque falls within a predetermined reference range.

2. The reading apparatus according to claim 1, wherein the hardware processor performs the first control to control the motor such that the rotational speed becomes a predetermined rotational speed.

3. The reading apparatus according to claim 1, wherein in response to the torque of the motor being out of the predetermined reference range under the first control, the hardware processor switches to the second control as to the operation of the motor.

4. The reading apparatus according to claim 1, wherein the hardware processor performs the second control such that a difference between the torque of the motor as a control target and the torque of, among the motors, a motor that rotates, among the rollers, a roller located, in the conveyance direction, downstream of a roller that the motor as the control target rotates falls within a predetermined reference difference range.

5. The reading apparatus according to claim 1, wherein in response to a difference between the torque of the motor as a control target and the torque of, among the motors, a motor that rotates, among the rollers, a roller located, in the conveyance direction, of a roller that the motor as the control target rotates being out of a predetermined reference difference range, the hardware processor switches to the second control as to the operation of the motor as the control target.

6. The reading apparatus according to claim 1, wherein in response to the rotational speed of the motor being out of a predetermined set speed range under the second control, the hardware processor switches to the first control as to the operation of the motor.

7. The reading apparatus according to claim 1, wherein the hardware processor performs the first control when, among the rollers, a roller corresponding to the motor starts to rotate, and switches to the second control after the rotational speed of the roller increases to a predetermined set speed.

8. The reading apparatus according to claim 1, further comprising a recording medium detector that detects the recording medium at a specific position, wherein the hardware processor identifies a position of the recording medium based on a result of the detection by the recording medium detector, and switches between the first control and the second control in accordance with the identified position.

9. The reading apparatus according to claim 1, further comprising driven rollers corresponding to the rollers, the driven rollers rotating as their corresponding rollers rotate.

10. The reading apparatus according to claim 1, wherein the motors are brushless motors.

11. A conveying operation control method for a reading apparatus including: a reader that reads a surface of a recording medium with an image formed; a conveyor that includes rollers disposed along a conveyance path that passes through a reading area of the reader, and conveys the recording medium being laid across the rollers; and motors that rotate the rollers, comprising:

as to at least one motor of the motors, switching between and performing a first control to adjust a rotational speed and a second control to adjust a torque, depending on an operating state of the motor, wherein set speeds of the motors are determined such that the rollers located farther downstream in a conveyance direction of the recording medium rotate faster; and wherein the second control controls the motor such that the torque falls within a predetermined reference range.

12. A non-transitory computer-readable storage medium storing a program that causes a computer of a reading apparatus including: a reader that reads a surface of a recording medium with an image formed; a conveyor that includes rollers disposed along a conveyance path that passes through a reading area of the reader, and conveys the recording medium being laid across the rollers; and motors that rotate the rollers, wherein set speeds of the motors are determined such that the rollers located farther downstream in a conveyance direction of the recording medium rotate faster, to:

as to at least one motor of the motors, switch between and perform a first control to adjust a rotational speed and a second control to adjust a torque, depending on an operating state of the motor;

wherein the second control controls the motor such that the torque falls within a predetermined reference range.

* * * * *